US007377748B2

(12) United States Patent
Mongillo, Jr. et al.

(10) Patent No.: US 7,377,748 B2
(45) Date of Patent: May 27, 2008

(54) FANNED TRAILING EDGE TEARDROP ARRAY

(75) Inventors: Dominic J. Mongillo, Jr., West Hartford, CT (US); Young H. Chon, Manchester, CT (US); Raymond Kulak, deceased, late of New Britain CT (US); by Eugene Kulak, legal representative, New Britain, CT (US)

(73) Assignee: United Technologies Corporation, Hartford, CT (US)

( * ) Notice: Subject to any disclaimer, the term of this patent is extended or adjusted under 35 U.S.C. 154(b) by 383 days.

(21) Appl. No.: 11/232,701

(22) Filed: Sep. 22, 2005

(65) Prior Publication Data

US 2007/0224033 A1 Sep. 27, 2007

Related U.S. Application Data

(63) Continuation of application No. 10/754,265, filed on Jan. 9, 2004, now Pat. No. 7,021,893.

(51) Int. Cl.
*F03B 11/00* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS

| | | | | |
|---|---|---|---|---|
| 4,786,233 | A * | 11/1988 | Shizuya et al. | 416/97 R |
| 5,288,207 | A | 2/1994 | Linask | |
| 5,503,529 | A | 4/1996 | Anselmi et al. | |
| 5,931,638 | A | 8/1999 | Krause et al. | |
| 5,975,851 | A | 11/1999 | Liang | |
| 6,164,913 | A | 12/2000 | Reddy | |

* cited by examiner

*Primary Examiner*—Igor Kershteyn
(74) *Attorney, Agent, or Firm*—Bachman & LaPointe

(57) ABSTRACT

A component for use in a gas turbine engine is provided. The component has an airfoil portion with a plurality of internal cooling passages and a non-linear trailing edge. The component further has a non-linear array of teardrop shaped assemblies which form a plurality of injection slots for injecting a coolant fluid into a fluid passing over the airfoil portion. The teardrop shaped assemblies are designed to maximize thermal performance of the component by reducing a relative diffusion angle between the injected coolant flow and the streamline direction of the fluid passing over the airfoil portion.

6 Claims, 2 Drawing Sheets

FANNED TRAILING EDGE TEARDROP ARRAY

CROSS-REFERENCE TO RELATED APPLICATION(S)

This application is a continuation application of U.S. patent application Ser. No. 10/754,265, filed Jan. 9, 2004 now U.S. Pat. No. 7,021,893, entitled FAN TRAILING EDGE TEARDROP ARRAY, By Dominic J. Mongillo, Jr. et al.

STATEMENT OF GOVERNMENT INTEREST

The Government of the United States of America may have rights in the present invention as a result of Contract No. N00019-02-C-3003 awarded by the Department of the Navy.

BACKGROUND OF THE INVENTION (a) Field of the Invention

The present invention relates to a turbine engine component having a fanned trailing edge teardrop array for improving aerodynamic and thermal performance.

(b) Prior Art

A large number of turbine blades have internal cooling passages. Often, fluid in the rearmost cooling passage is ejected externally of the blade. One such coolant ejection system is shown in U.S. Pat. No. 5,503,529 to Anselmi et al. Another such blade is shown in U.S. Pat. No. 6,164,913 to Reddy.

The Anselmi et al. patent shows a turbine blade having angled ejection slots. The ejection slots are formed in one of the airfoil sidewalls. Adjacent the slots are a plurality of tapering ribs for directing the fluid afterward. In order for the flow in a coolant passageway to enter one of the slots, the flow must turn more than 90 degrees. As a result, the Anselmi et al. blade has poor thermal performance.

The Reddy blade is similar in design to the Anselmi et al. blade. In Reddy, the ejection slots empty the coolant fluid being discharged into a trough arranged in a column immediately adjacent the trailing edge. The column of troughs is disposed in the pressure sidewall of the blade. Each trough has sidewalls which decrease in depth for blending the troughs downstream to the trailing edge. Further, the sidewalls of each trough diverge radially for distributing the coolant ejected from the slots. This blade is also suffers from poor thermal performance.

In turbine applications, coolant air flowing through film holes and trailing edge exits in the airfoil portion of a turbine blade contributes efficiency loss due to coolant injection mixing with the gas path and accelerating the coolant into the free stream velocity. The greater the angles between the free stream gas path and the coolant injection, the greater the loss of efficiency. While teardrop designs are known in the art, they have conventionally been designed axially regardless of the gas path streamline angles.

SUMMARY OF THE INVENTION

It is an object of the present invention to provide a turbine engine component having a reduced aero mixing loss by aligning coolant injection slots features with non axial airfoil surface streamlines which improves overall turbine mixing efficiency and minimizes additional mixing loss.

It is a further object of the present invention to provide a turbine engine components that has improved thermal performance as a result of a reduction in the relative diffusion angle between the injected coolant flow and the streamline direction of the mainstream gas.

It is yet a further object of the present invention to provide an improved trailing edge slot film effectiveness and improved internal performance.

The foregoing objects are attained by the present invention.

In accordance with the present invention, a component for use in a gas turbine engine is provided. The component broadly comprises an airfoil portion having a trailing edge, and means for maximizing thermal performance of the component by reducing a relative diffusion angle between an injected coolant flow and a streamline direction of a fluid passing over the airfoil portion. The component may be a variety of turbine engine components including, but not limited to, a blade and a vane.

Other details of the fanned trailing edge teardrop array, as well as other objects and advantages attendant thereto, are set forth in the following detailed description and the accompanying drawings wherein like reference numerals depict like elements.

DETAILED DESCRIPTION OF THE PREFERRED EMBODIMENTS

Figure 1:
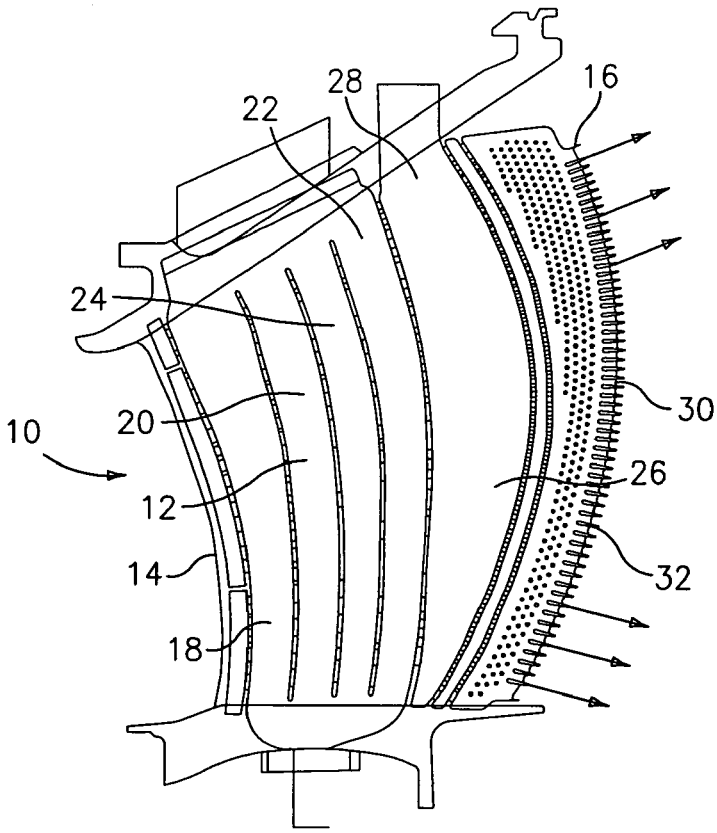
FIG. 1 illustrates a turbine engine component in accordance with the present invention.

Referring now to FIG. 1, a component 10 to be used in a gas turbine engine is shown. The component 10 may be a turbine blade or a vane. The component 10 has an airfoil portion 12 with a leading edge 14 and a non-linear, preferably arcuately, shaped trailing edge 16. Internal of the component 10 are cooling passageways 18, 20, 22, and 24. Also internal of the component 10 is a trailing edge cooling passage 26 which has an inlet 28 for receiving a cooling fluid.

A plurality of cooling fluid injection slots 30 are located in the trailing edge region of the component 10. The injection slots 30 are formed by a non-linear, preferably arcuate, array of spaced apart teardrop shaped assemblies 32. Each teardrop shaped assembly 32 preferably has an arcuate shaped leading edge 34, flat portions 36 and 38 extending outwardly from the leading edge 34, and tapering angled portions 40 and 42 extending from the flat portions 36 and 38 to a trailing edge 44. The extent of the flat portions 36 and 38 depends upon the flow passing through the slots 30. If desired, the flat portions 36 and 38 may be omitted. Each teardrop shaped assembly 32 has a central longitudinal axis 46. The injection slots 30 are designed to create a fan shaped coolant flow which mimics the gas path free stream (see FIGS. 1 and 3).

The cooling passage 26 has a plurality of outlets 50 through which cooling fluid leaves the passage 26. The outlets 50 are also arranged in a non-linear, preferably arcuate, array. Each of the individual outlets 50 is formed by a pair of spaced apart ribs 52 and 54 positioned in one of the arcuately shaped walls 53 and 55. Each cooling fluid outlet 50 has a central axis 56 which is preferably aligned with the longitudinal axis 46 of one of the teardrop shaped assemblies 32.

Figure 2:
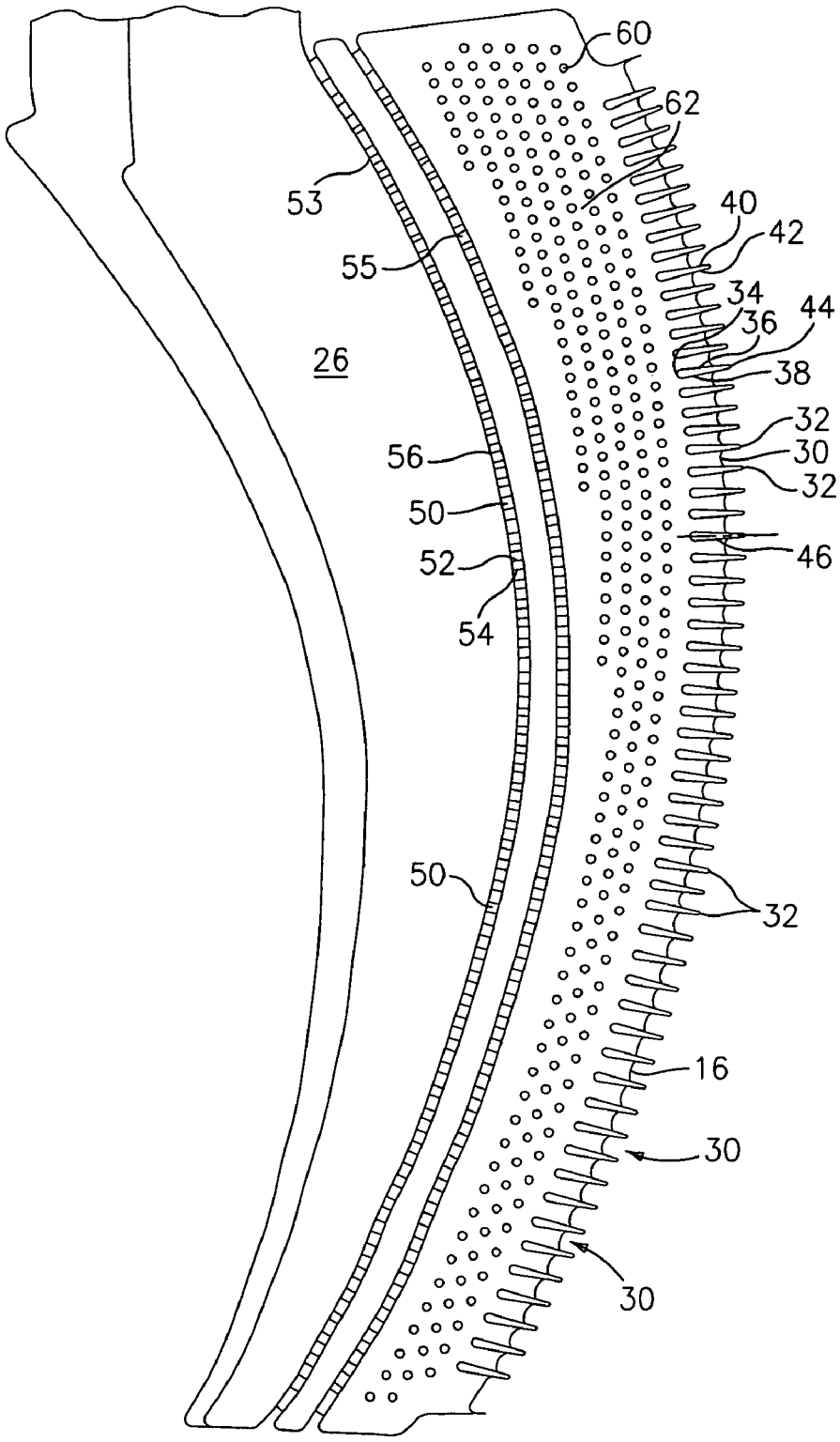
FIG. 2 is an enlarged view of the trailing edge portion of the turbine engine component of FIG. 1 showing the fanned trailing edge teardrop array of the present invention.

Intermediate the outlets 50 and the teardrop shaped assemblies are a plurality of pedestals 60 which form a plurality of flow passages 62. As can be seen from FIGS. 1 and 2, the pedestals 60 vary in density in a spanwise direction. The pedestals 60 are configured so that the flow exiting one of the outlets 50 impinges directly onto one of the pedestals 60. The flow passages 62 formed by the pedestals 60 are preferably axially aligned with the injection slots 30. Further as can be seen in FIG. 2, a plurality of the pedestals 60 may be aligned along an axis which coincides with the central longitudinal axis 46 of the teardrop shaped assemblies 32.

By providing the above described structure, it is possible to reduce aero mixing loss by aligning the coolant injection slots 30 with non axial airfoil surface streamlines. This improves the overall turbine mixing efficiency and minimizes the additional mixing loss that occurs with axially aligned teardrops.

Further, the above described structure maximizes thermal performance by reducing the relative diffusion angle between the injected coolant flow and the streamline direction of the mainstream fluid. The reduction of the relative angle between the coolant and the mainstream fluid flow minimizes the potential for separated flow off the teardrop diffuser. Separated flow off a trailing edge teardrop feature can lead to premature oxidation of the trailing edge region, resulting in accelerated reduction in turbine efficiency, performance, and airfoil life.

The design of the present invention also optimizes trailing edge slot film effectiveness resulting from non separated flow off non-axial trailing edge teardrop features which increases trailing edge adiabatic film effectiveness and reduces suction side lip metal temperatures resulting in improved thermal performance.

The design of the present invention by aligning trailing edge teardrop features with upstream coolant flow field direction minimizes the potential for internal flow separation and additional pressure loss off the trailing edge teardrop features resulting in a reduction of the overall flow capacity of the trailing edge circuit for a given trailing edge slot geometry and flow area. The reduction in flow capacity may adversely impact the overall thermal performance of trailing edge design reducing its cooling potential for a fixed operating pressure ratio from $P_{supply}$ to $P_{static}$ dump.

The non-axial teardrop features of the present invention improve the ceramic core producibility by minimizing the required throat meter length between adjacent teardrop features. Since it is important that an effective metering length be established to accurately control the trailing edge slot flow, a minimum slot length based on the slot hydraulic diameter is required. Given the axial bow and curvature of the local trailing edge, it is advantageous to orient the teardrop features as shown above to minimize the required meter length necessary to establish fully developed flow. In doing so, the overall teardrop length can be reduced which significantly improves the moment of inertia characteristics of the trailing edge teardrop feature and improves the overall stiffness of the trailing edge core and producibility.

Figure 3:
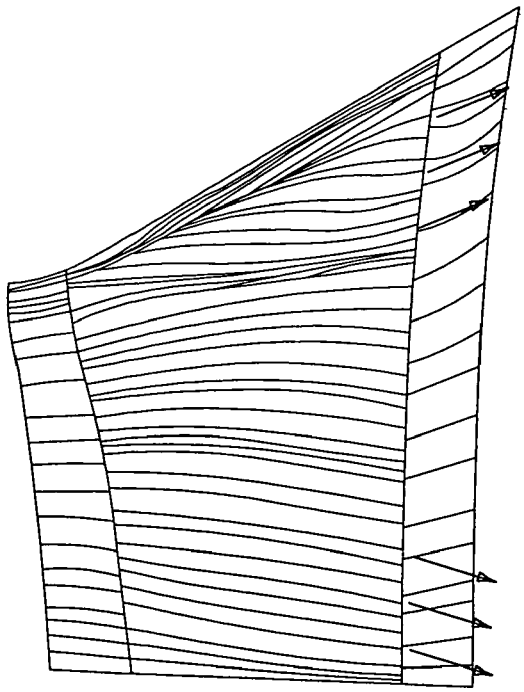
FIG. 3 illustrates the gas path free stream line.

By fanning the teardrop shaped assemblies of the present invention as shown in FIGS. 1 and 2 to match the free stream shown in FIG. 3, the efficiency loss can be significantly reduced.

It is apparent that there has been provided in accordance with the present invention a fanned trailing edge teardrop array which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A component for use in a gas turbine engine comprising:

an airfoil portion having a trailing edge;

a coolant passageway having a plurality of coolant outlets formed by a plurality of spaced apart ribs;

a pedestal array intermediate said coolant passageway and said trailing edge;

said pedestal array having a spanwise variable density; and an arcuate array of teardrop shaped assemblies positioned adjacent said trailing edge and forming an arcuate array of injection slots for injecting a fan shaped coolant flow into a fluid passing over said airfoil portion.

2. The component of claim 1, further comprising each said teardrop shaped assembly having a central longitudinal axis and said central longitudinal axis being aligned with an axis of a respective coolant outlet formed by two of said spaced apart ribs.

3. The component of claim 1, wherein each said coolant outlet is aligned with one of said pedestals in said pedestal array so coolant fluid exiting said coolant outlet impinges on said one pedestal.

4. The component of claim 1, wherein said pedestal array comprises a plurality of pedestals defining a plurality of fluid passageways which extend between said coolant outlets and said injection slots and wherein each of said fluid passageways is substantially aligned with a coolant injection slot formed by adjacent ones of said teardrop assemblies.

5. The component according to claim 4, wherein at least one of said plurality of pedestals in said pedestal array is aligned along an axis which coincides with a central longitudinal axis of a teardrop shaped assembly.

6. The component according to claim 4, wherein a plurality of pedestals in said pedestal array is aligned along an axis which coincides with a central longitudinal axis of a teardrop shaped assembly.

* * * * *